US008443978B2

(12) United States Patent
Royer

(10) Patent No.: US 8,443,978 B2
(45) Date of Patent: May 21, 2013

(54) PACKAGE FOR MEDICAMENT

(75) Inventor: Christophe Royer, Huningue (FR)

(73) Assignee: Novartis AG, Basel (CH)

( * ) Notice: Subject to any disclaimer, the term of this patent is extended or adjusted under 35 U.S.C. 154(b) by 273 days.

(21) Appl. No.: 12/520,362

(22) PCT Filed: Dec. 20, 2007

(86) PCT No.: PCT/EP2007/011291

§ 371 (c)(1),
(2), (4) Date: Jun. 19, 2009

(87) PCT Pub. No.: WO2008/077589

PCT Pub. Date: Jul. 3, 2008

(65) Prior Publication Data

US 2010/0011714 A1 Jan. 21, 2010

(30) Foreign Application Priority Data

Dec. 22, 2006 (EP) ..... 06127141

(51) Int. Cl.
*B65D 83/04* (2006.01)

(52) U.S. Cl.
USPC ..... 206/538; 206/1.5

(58) Field of Classification Search
USPC ..... 206/528, 531, 532, 534.1, 538, 1.5, 206/39.6, 758
See application file for complete search history.

(56) References Cited

U.S. PATENT DOCUMENTS

| | | | | |
|---|---|---|---|---|
| 4,301,917 | A | 11/1981 | Ancell | 206/39 |
| 4,465,208 | A | 8/1984 | Buban et al. | 221/279 |
| 4,817,819 | A * | 4/1989 | Kelly | 221/2 |
| 6,460,693 | B1 * | 10/2002 | Harrold | 206/1.5 |
| 7,090,079 | B2 * | 8/2006 | Ehrlund | 206/531 |
| 2005/0183981 | A1 * | 8/2005 | Gelardi | 206/531 |
| 2006/0131205 | A1 * | 6/2006 | Sandberg et al. | 206/538 |
| 2007/0102318 | A1 * | 5/2007 | Gelardi et al. | 206/538 |
| 2009/0065506 | A1 * | 3/2009 | Currie et al. | 220/324 |

FOREIGN PATENT DOCUMENTS

| | | |
|---|---|---|
| FR | 2592003 | 6/1987 |
| WO | WO2005/068304 | 7/2005 |

* cited by examiner

*Primary Examiner* — Jacob K Ackun
(74) *Attorney, Agent, or Firm* — Carmella A. O'Gorman

(57) ABSTRACT

A package for a medicament, the package comprising a sleeve and a slide, the slide having a medicament region for containing medicament, the sleeve having opposed first and second major surfaces connected and spaced apart by a side wall to define an internal volume, the side wall further defining a slide opening, the slide being movable parallel to a slide axis between a position in which the medicament region is substantially within the internal volume and a position in which at least some of the medicament region extends outside the internal volume through the slide opening, characterized in that the sleeve includes a shoulder and the package includes biasing means, the sleeve and slide being arranged such that the slide is movable within the internal volume between a secured position, in which slide is substantially prevented from moving parallel to the slide axis by contact between a portion of the slide and the shoulder, and an unsecured position, in which the slide portion can move parallel to the slide axis through the slide opening, the biasing means resiliently biasing the slide to the secured position. The invention extends to a blank for fabricating a sleeve for such a medicament package and to a slide or sleeve for use in such a medicament package.

6 Claims, 4 Drawing Sheets

PACKAGE FOR MEDICAMENT

This application is a 371 of PCT/EP2007/011291, filed Dec. 20, 2007.

The present invention relates to a packaging for a medicament, particularly to a packaging for a medicament that offers enhanced child resistance.

It is known to supply medicaments in many types of packaging, a common form of which is a box which contains one or more sheets housing medicament in a plurality of containers sealed by a material that can be ruptured or removed to give access to the medicament therein. The sheet is typically a plastics sheet, which may be a plastics laminate, which is formed to include blisters into which a medicament is dispensed or placed. The blisters are then substantially sealed by a film, typically a foil laminate, which is removed or ruptured to provide access to the medicament. Such containers for medicament are known as 'blisters' and sheets thereof are known as 'blister sheets'.

Some medicaments can be potentially harmful if used incorrectly and access to them, particularly by children, should be controlled. Child resistant packaging is available which is intended to make it more difficult for a child to gain access to such medicaments. However, child resistant packaging can be costly to manufacture and can make it difficult for patients or caregivers to access required medicaments, particularly if the patient or caregiver has limited or impaired dexterity.

It is an object of the present invention to address some of the above issues.

According to the invention there is provided a package for a medicament, the package comprising a sleeve and a slide, the slide having a medicament region for containing medicament, the sleeve having opposed first and second major surfaces connected and spaced apart by a side wall to define an internal volume, the side wall further defining a slide opening, the slide being movable parallel to a slide axis between a position in which the medicament region is substantially within the internal volume and a position in which at least some of the medicament region extends outside the internal volume through the slide opening, characterised in that the sleeve includes a shoulder and the package includes biasing means, the sleeve and slide being arranged such that the slide is movable within the internal volume between a secured position, in which slide is substantially prevented from moving parallel to the slide axis by contact between a portion of the slide and the shoulder, and an unsecured position, in which the slide portion can move parallel to the slide axis through the slide opening, the biasing means resiliently biasing the slide to the secured position.

The sleeve can be formed from any suitable material such as a plastics material, or may be formed from cardboard which may be reinforced, for example by laminating with a plastics material, cardboard or other material, if required. It should be understood that the term cardboard is used herein to include cartonboard, paperboard and other card or paper materials.

The major surfaces of the sleeve may be substantially identical in size and can be substantially rectangular in shape each having two major sides and two minor sides. The side wall may comprise a plurality of wall units which may combine to form a substantially continuous wall, or which may not be directly connected to other wall units. The side wall extends between and connects the major surfaces and cooperates with said surfaces to define an interior volume. The side wall may be arranged substantially at right angles to the major surfaces such that the sleeve has a substantially cuboid shape if the major surfaces are substantially rectangular.

The slide may be substantially rectangular and the sleeve and slide may be arranged such that the slide fits substantially entirely within the internal volume defined within the sleeve and, when within the internal volume, can be arranged substantially parallel with one of the major surfaces.

The medicament region preferably occupies a substantially central region of at least one face of the slide. The medicament region may include a plurality of blisters containing medicament as is well known in the art. It should be understood that the medicament can be in any form, for example tablets, powders, capsules or liquids, which may be contained in other containers. The slide may comprise a blister sheet reinforced with card, the card being located on one or both sides of the blister sheet in the substantially flat regions between the blisters or on the side opposite the raised blisters so as to increase the rigidity of the blister sheet. The card may be bonded to the blister sheet and the card may substantially cover the breakable material that seals the blisters. If the card substantially covers the breakable material that seals the blisters, the card may be pre-weakened, for example by scoring or perforating the card, in the region of the blister to facilitate access to the medicament. Blisters in the medicament region may be raised from the sheet on one or both sides of the slide.

At least some of the slide is able to pass through the slide opening so that the slide can be moved by a user between a position in which the medicament region is substantially within the internal volume, a closed position, and a position in which at least some of the medicament region extends outside the internal volume through the slide opening, an open position.

The slide may have an anchor end portion and a leading end portion and be arranged within the sleeve such that the leading end is the first to pass through the slide opening when the slide is moved from a closed position to an open position. The leading portion may include a pull tab extending therefrom which is arranged to extend through the opening when the slide is in the unsecured position to facilitate a user grasping and moving the slide. The anchor portion may include an anchor which cooperates with the sleeve to hinder complete separation of the sleeve and slide. The anchor may be a projection from the anchor end portion that engages with a stop to hinder complete separation of the sleeve and slide. The stop may be formed by the shoulder.

The shoulder may be arranged anywhere within the sleeve, but is preferably at or adjacent the opening for ease of manufacture. In one embodiment the side wall in the region of the slide opening does not extend fully between the major surfaces, or that the sidewall does not fully extend the length of one side of the major surfaces such that the side wall forms at least part of the shoulder.

The biasing means can be formed from any suitable means for resiliently biasing the slide, for example leaf springs, helical springs, resiliently deformable plastics or rubber materials. In one embodiment the biasing means are fabricated from the same material as the sleeve, for example cardboard or cartonboard. The biasing means can be integrally formed with the sleeve, for example by bending one or more portions of the material forming the sleeve into the internal volume. This can achieved by forming a biasing portion of the sleeve material such that it is connected to the sleeve only at a fold line such that a fold along the fold line can cause the biasing portion to extend into the interior volume. The fold can be fold of less than 90° or more than 90°. The fold, or other means, then provides the resilient biasing force applied to the slide.

The biasing means preferably do not substantially hinder movement of the slide through the opening, unless they form some or all of the shoulder. The biasing means may be contained within the sleeve. There may be a plurality of biasing means. One or more biasing means may be located anywhere, for example substantially centrally, with respect to one major surface or facet of the side wall, or may be located adjacent an edge of one of the major surfaces. In one embodiment the biasing means are fabricated from a resiliently deformable plastics material and are bonded, glued or otherwise attached to the sleeve, for example the biasing means could be glued to an internal surface of the sleeve.

Within the sleeve the biasing means resiliently bias the slide to a secured position in which the shoulder prevents the slide from being withdrawn through the opening to expose at least some of the medicament area. In the secured position movement of the slide is substantially constrained by a combination of the shoulder, side wall and one or more major surface such that movement of the slide through the slide opening is substantially prevented without deformation of the biasing means. From the secured position the slide may only be movable to a different position within the sleeve.

In order to withdraw the slide from the sleeve a user must apply a force to the slide so as to deform the biasing means and move the slide away from the shoulder to an unsecured position in which the slide portion can move through the slide opening. This can be through direct contact with the slide or otherwise. In the unsecured position a leading edge of the slide is located at or adjacent the slide opening such that a user is able to grasp the slide, or a portion attached to the slide, and apply a removal force thereto to cause the slide to move parallel to the slide axis through the slide opening. The biasing is preferably in a direction substantially perpendicular to the direction of the slide axis. It should be understood that as the slide is moved between the secured position and the unsecured position the slide will pass through various orientations within the sleeve. It is preferred that the slide is still constrained to move only within the sleeve until the unsecured position is substantially reached and at least some of the slide can be withdrawn.

The displacement of the slide required to move the slide from the secured position to the unsecured position may be substantially linear, but may be rotational, or a combination of rotational and linear movement. If a substantially linear movement to move between secured and unsecured positions within the sleeve is used then said linear movement may be substantially perpendicular to the substantially linear sliding motion required to withdraw the slide from the sleeve.

In order to move the slide between the secured and unsecured positions a force must be applied to the slide to overcome the biasing force of the biasing means. The force may be applied directly to the slide by a user contacting the slide, or via a mechanism or other means.

Buttons may be provided on the sleeve which, when pressed by a user, cause a mechanism, such as a lever, combination of levers or other transducers, to contact and apply a force to the slide. The sleeve may include resiliently deformable contact regions which an be deformed by the a user such that the contact region makes contact with the slide to apply the force.

At least one cutout or aperture can be provided through the sleeve allowing a user to directly contact the slide and apply a force thereto. In one embodiment two cutouts or apertures are provided through the sleeve to allow a user to contact the slide directly and apply a force thereto. If two cutouts or apertures are provided, a user may be required to provide a substantially equal displacement at each cutout or aperture location to move the slide to the unsecured position. The cutouts or apertures may be spaced apart such that it would be difficult or substantially impossible for a child to use a single hand to apply a force to the slide at both locations, while an adult would be able to perform such an operation thereby leavening one hand free to grasp the slide, or otherwise apply a removal force to the slide. As noted above, a deformable membrane may substantially cover and/or seal the cutout portions, the membrane being such that a user can deform the membrane to apply a force to the slide. The membrane may be a single membrane or formed from a plurality of parts. The membrane may be, for example an elastic membrane or a membrane fabricated from the same material as the sleeve. The membrane may be integrally formed with the sleeve.

The invention extends to cardboard blanks that could be used to fabricate the sleeve and or the slide.

The invention further extends to a method for opening a medicament package, the medicament package comprising a sleeve and a slide, the slide fitting within the sleeve and being removable from the sleeve through a slide opening, the sleeve and slide being arranged such that the slide is movable within the sleeve between a secured position and an unsecured position and the slide being biased towards the secured position, the method including the steps of:

a. a user using a first hand to apply a force to the slide to move it to the unsecured position and hold it there; and
b. the user using a second hand to apply a removal force to the slide to move at least some of the slide though the slide opening.

It should be understood that throughout this specification and in the claims that follow, unless the context requires otherwise, the word "comprise", or variations such as "comprises" or "comprising", implies the inclusion of the stated integer or step, or group of integers or steps and not the exclusion of other possible integers.

The invention will now be further described, by way of example only, with reference to the following drawings, in which.

Figure 1:
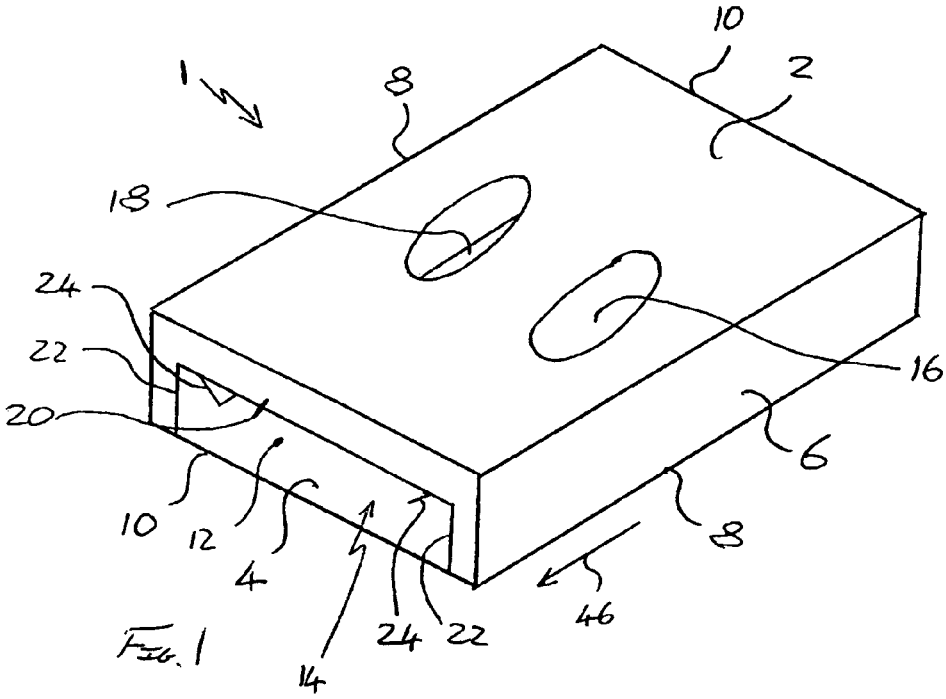
FIG. 1 shows a profile view of a sleeve of a medicament package.

FIG. 1 shows a sleeve 1 comprising first and second major surfaces 2,4 which are connected and spaced apart by a side wall 6. The major surfaces 2,4 are substantially rectangular and each have major edges 8 and minor edges 10. The side wall 6 extends substantially fully around the edges 8,10 of the major surfaces 2,4 to define an internal volume 12. The sleeve 1 includes a slide opening 14 through the side wall 6 and two cutouts 16,18 through major surface 2 thereby permitting access to the internal volume 12. Each cutout 16,18 is dimensioned to allow a finger of an adult user to pass therethrough to apply a force to a slide 30 (shown in FIG. 2) within the sleeve 1. The slide opening 14 of the sleeve 1 is defined by a first shoulder 20 and two side shoulders 22.

The cutouts are spaced apart such that a child cannot use a single hand to apply a force to the slide through both cutouts simultaneously (a child would therefore have to use both hands to move the slide to the unsecured position and would be hindered from moving the slide through the slide opening). It should be understood that, although the cutouts 16,18 are shown arranged spaced apart along a line perpendicular to the major edges 8, the cutouts 16,18 may be spaced apart along a line parallel with the major edges 8 or not aligned with an edge at all. There may also be additional cutouts (not shown) which are similarly spaced apart from other cutouts to prevent children readily moving the slide to the unsecured position with a single hand. Additional cutouts may be decoy or dummy cutouts which are dimensioned or positioned such that the slide cannot be directly contacted or such that the slide cannot be moved to the unsecured position using those cutouts.

The sleeve 1 further includes biasing means, in this case resilient flaps 24 within the internal volume 12. The function of the flaps 24 will be explained in more detail with reference to FIG. 3.

Figure 2:
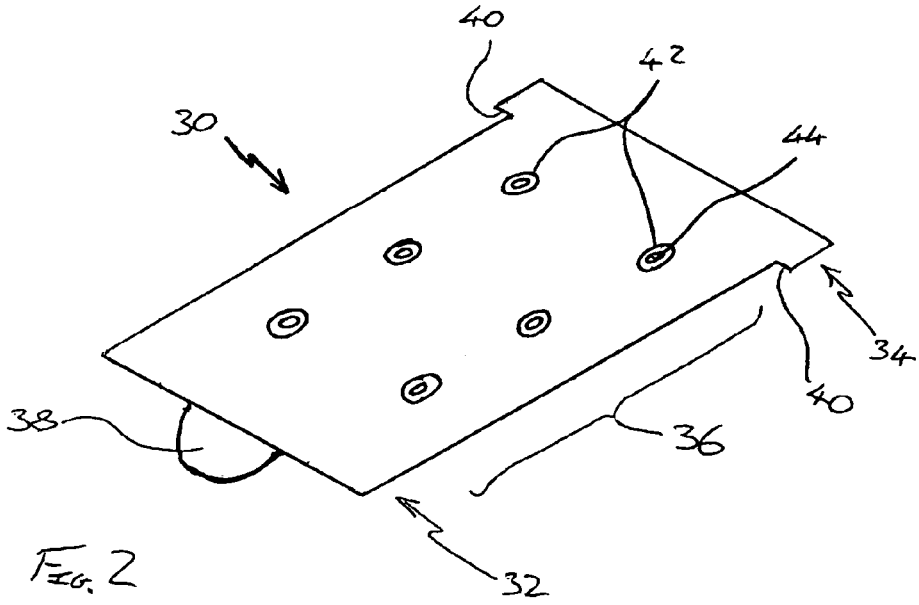
FIG. 2 shows a profile view of a slide of a medicament package suitable for use with the sleeve of FIG. 1.

FIG. 2 shows a slide 30 suitable for use with the sleeve of FIG. 1. The slide 30 comprises a leading portion 32, an anchor portion 34 and a medicament region 36. The leading portion 32 includes a pull-tab 38 extending therefrom to facilitate grasping of the slide 30. The anchor portion 34 includes side extensions 40 that cooperate with the side shoulders 22 of the sleeve 1 to hinder separation of the slide from the sleeve.

The medicament region 36 of the slide 30 includes a plurality of individual medicament containers 42 each containing a predetermined quantity of a medicament 44 in tablet or capsule form. The containers 42 are formed as blisters in a sheet and sealed with a rupturable material as is well known and will not be further described in detail. In this case the blisters are shown extending towards the first major surface 2, but it should be understood that they could also/alternatively face in the other direction towards the second major surface 4.

Figure 3:
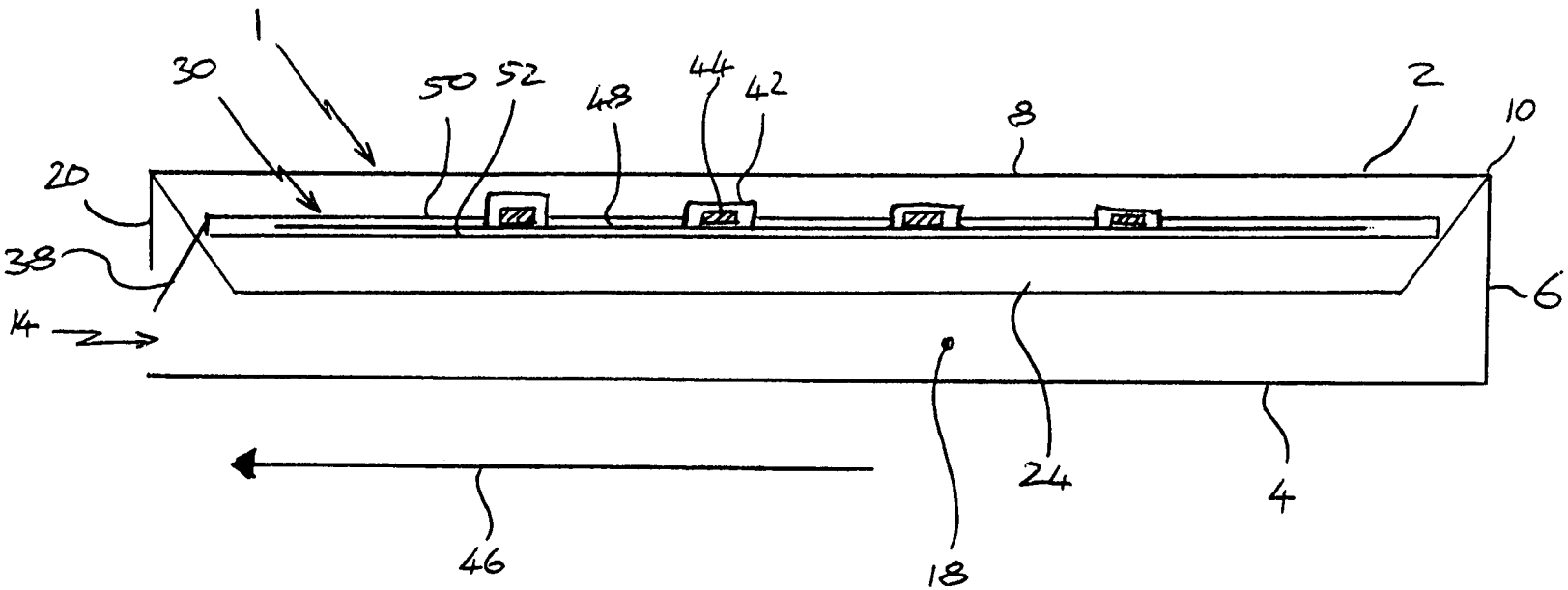
FIG. 3 shows a cross section through a medicament package using the sleeve of FIG. 1 and the slide of FIG. 2.

FIG. 3 shows a cross section through packaging which combines the sleeve 1 of FIG. 1 with the slide 30 of FIG. 2.

FIG. 3 shows the packaging with the slide 30 within the sleeve 1 and in a secured position which is the rest position of the packaging. In the secured position the flaps 24 resiliently bias the slide towards, in this case, the first major surface 2. The slide is biased in this direction in this case as the slide opening 14 is adjacent the second major surface 4 and the shoulder 20 is adjacent the first major surface 2. In the secured position the shoulder 20 substantially limits movement of the slide 30 in a direction parallel to the slide axis 46 so that medicament region 36 of the slide 30 cannot be removed from the packaging. The flaps 24 in this packaging extend into the internal volume 12 from major edges 8 of the first major surface 2 and are biased towards the first major surface 2. The slide 30 is arranged between the opposed flaps 24 and is therefore biased towards the first major surface 2.

In use, a user could place the packaging on a surface, for example a table top and place fingers of one hand through the cutouts 16,18 to contact the slide 30. The user would then apply a force to the slide 30 to overcome the biasing force of the flaps 24 such that the slide 30 moved towards the second major surface 4 in a direction substantially perpendicular to the slide axis 46. As the slide 30 moves towards the second major surface 4, the pull tab 38 will extend through the slide opening 14 and enable a user to easily grasp the slide 30. When the user has applied sufficient force to the slide 30 for the slide to be displaced such that the leading portion 32 is adjacent the slide opening 14 (the unsecured position) rather than the shoulder 20 the user can pull on the pull-tab 38 and withdraw the slide 30 from the sleeve 1 through the slide opening 14 to reveal the medicament region 36.

The user is substantially prevented from separating the slide 30 from the sleeve 1 by engagement of the side extensions 40 of the slide 30 with the side shoulders 22 of the sleeve 1. The side extensions 40 form anchors which extend from the anchor portion 34 of the slide. When a user has removed the required medicament 44, the slide 30 is pushed back into the sleeve 1 and the resilient flaps 24 will bias the slide 30 back into the secured position with the leading edge adjacent the shoulder 20.

As shown in FIG. 3, the medicament region 36 of slide 30 comprises a blister sheet 48 substantially encapsulated between two sheets of cardboard 50,52 to increase the structural rigidity of the slide 30.

Figure 4:
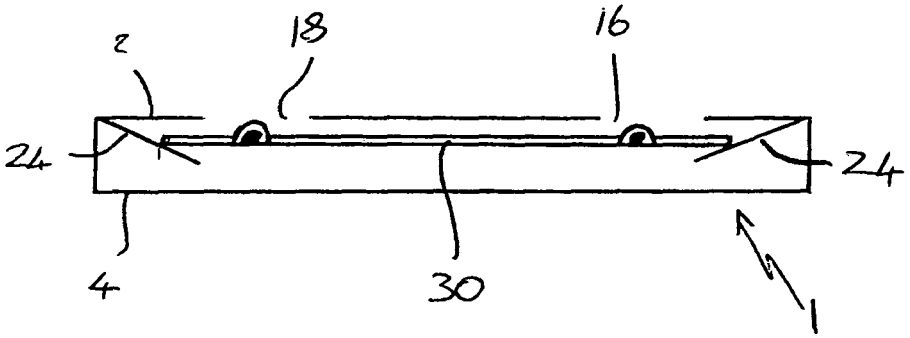
FIG. 4 shows a cross section through the medicament package of FIG. 3, but along a line perpendicular to that used for FIG. 3.

The arrangement of the slide and flaps in the internal volume 12 is shown more clearly in FIG. 4.

Figure 5:
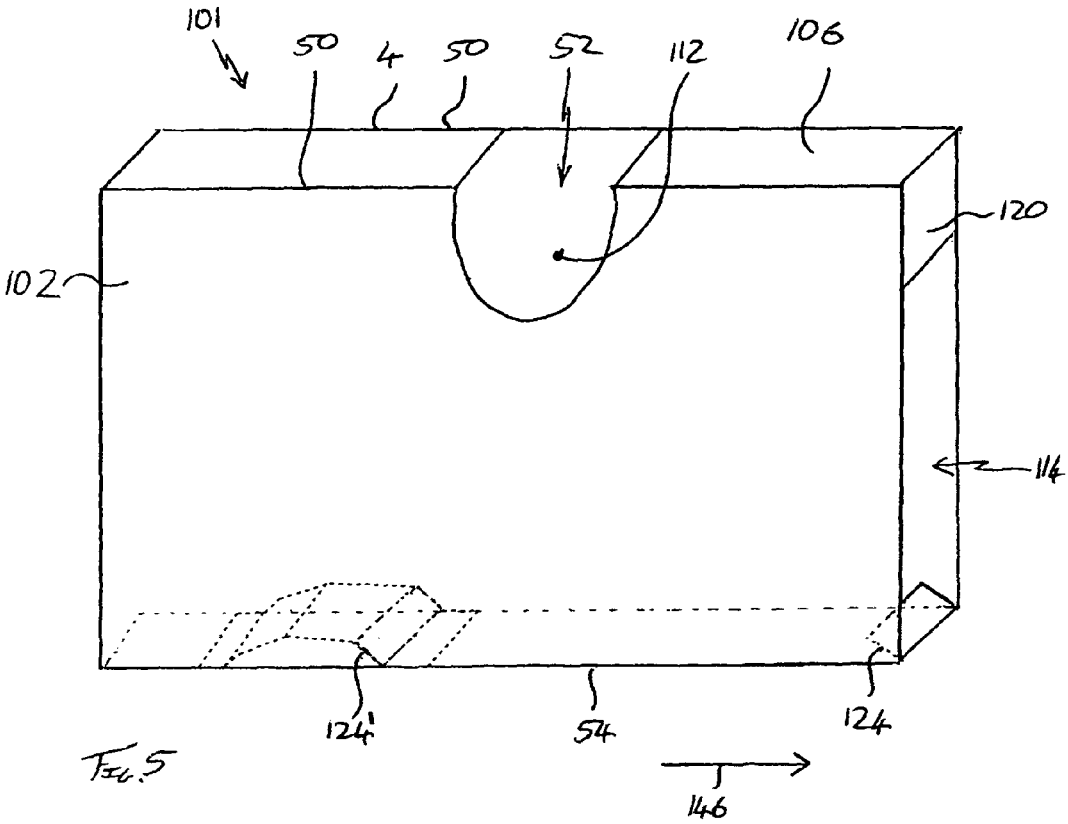
FIG. 5 shows a profile view of a sleeve of a second medicament package.
Figure 6:
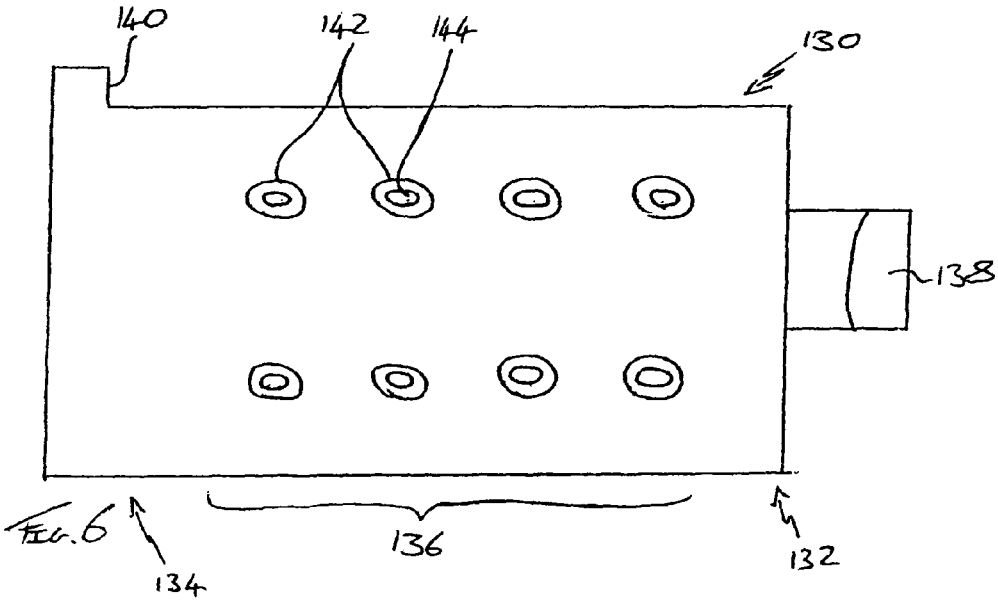
FIG. 6 shows a profile view of a slide of a medicament package suitable for use with the sleeve of FIG. 3.

In FIGS. 5 and 6 features that are the same as those of the sleeve or slide in previous figures will be labelled with the same reference numerals incremented by 100. These features will not be discussed in detail again.

FIG. 5 shows a shows a profile view of a sleeve 101 of a second medicament package.

In this case the slide opening 114 is still located at one end of the sleeve 101, but the shoulder 120 does not extend along a minor edge of a major surface 102, rather the shoulder 120 extends between the major surfaces to form a part of the side wall 106. The shoulder 120 is located adjacent a primary edge 50 of the major surfaces 102,104.

The sleeve includes a cutout 52 through a major surface 102 adjacent the primary edge 50 and extending into the sidewall 106. The cutout allows a user to access the internal volume 112.

The biasing means 124 are again formed by a flap, but the biasing means are located on a portion of the sidewall that extends along a secondary edge 54 of the major surfaces opposite the primary edge 50. The flap 124 is resiliently biased to extend away from the sidewall 106 and into the internal volume towards the primary edge 50. In this way, a slide located within the internal volume would be resiliently biased towards the primary edge 50 and thus into a secured position in which the shoulder 120 substantially restricted movement of the slide 130 in the direction of the slide axis 146.

FIG. 5 also shows an alternate embodiment of biasing means 124' which can be used in combination with, or as an alternative to other biasing means, such as those labelled 124. The biasing means 124' are fabricated from a resiliently deformable plastics material which, in this case, is fashioned into a bridge the ends of which are attached to an inner surface of the sleeve and a middle portion extending into the inner volume. Alternative biasing means of this form could be formed from cardboard or cartonboard and could be of a bridge form, flap form or other design.

FIG. 6 shows a slide 130 for use with the sleeve 101 of FIG. 5. The slide 130 includes only a single side extension 140, which in this case cooperates with the shoulder 120 to hinder separation of the sleeve 101 from the slide 130.

It should be understood that the invention has been explained above by way of example only and modifications in detail can be made within the scope of the claims.

The invention claimed is:

1. A package for a medicament, the package comprising:

a sleeve comprising:

a) opposed first and second major surfaces connected and spaced apart by side walls to define an internal volume, b) a slide opening in a side wall, the opening 1) being defined by a first shoulder and two side shoulders contacting the first and second major surfaces; or 2) comprising a shoulder extending between the major surfaces to form a part of the side wall;

c) one or more resilient flaps or bridges within the internal volume; and, d) at least one or more cutouts; and, a slide comprising an extension from a leading portion thereof to facilitate grasping of the slide by a user, and a medicament region for containing medicament;

wherein:

1) the one or more resilient flaps or bridges provide a biasing force to resiliently bias the slide towards the at least one or more cutouts to a secured position in which the shoulder substantially limits movement of the slide in a direction parallel to a slide axis; and 2) the slide is movable to an unsecured position by a force applied to the slide through the one or more cutouts to overcome the biasing force such that the shoulder does not substantially limit movement of the slide in a direction parallel to a slide axis allowing a user to move at least some of the medicament region through the slide opening along the slide axis.

2. A package as claimed in claim 1, in which the biasing means is fabricated from the same material as the sleeve.

3. A package as claimed in claim 1, in which the slide includes a plurality of individual rupturable medicament containing blisters.

4. A package as claimed in claim 1, in which the sleeve includes at least two cutouts.

5. A package as claimed in claim 1, in which the slide includes an anchor that cooperates with the sleeve to substantially prevent separation of the slide from the sleeve.

6. A package as claimed in claim 1, in which the sleeve is fabricated substantially from cardboard.

* * * * *